US006331695B1

(12) United States Patent
West

(10) Patent No.: US 6,331,695 B1
(45) **Date of Patent: *Dec. 18, 2001**

(54) THERMAL WARMING BLANKET FOR PATIENT TEMPERATURE MANAGEMENT

(75) Inventor: Arlen C. West, East Peoria, IL (US)

(73) Assignee: Wesco, Inc., East Peoria, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/588,393

(22) Filed: Jun. 6, 2000

Related U.S. Application Data

(63) Continuation-in-part of application No. 09/273,907, filed on Mar. 22, 1999, now Pat. No. 6,078,026.
(60) Provisional application No. 60/079,455, filed on Mar. 26, 1998.

(51) Int. Cl.[7] ..... H05B 3/34
(52) U.S. Cl. ..... 219/212; 219/528; 219/549; 607/96
(58) Field of Search ..... 219/211, 212, 219/527, 528, 535, 539, 549; 607/96, 108–111

(56) References Cited

U.S. PATENT DOCUMENTS

| | | | | |
|---|---|---|---|---|
| 2,342,744 | | 2/1944 | McCready . | |
| 3,417,229 | | 12/1968 | Shomphe . | |
| 3,422,244 | | 1/1969 | Lauck . | |
| 3,808,403 | | 4/1974 | Kanaya et al. . | |
| 3,878,362 | | 4/1975 | Stinger . | |
| 3,989,924 | | 11/1976 | Kurtzer . | |
| 4,042,803 | | 8/1977 | Bickford . | |
| 4,139,763 | * | 2/1979 | McMullan et al. | 219/528 |
| 4,198,562 | | 4/1980 | Mills et al. . | |
| 4,270,040 | * | 5/1981 | McMullan et al. | 219/528 |
| 4,279,255 | | 7/1981 | Hoffman . | |
| 4,293,763 | | 10/1981 | McMullan . | |
| 4,335,725 | | 6/1982 | Geldmacher . | |
| 4,358,668 | | 11/1982 | McMullan et al. . | |
| 4,429,215 | | 1/1984 | Sakai et al. . | |
| 4,507,877 | | 4/1985 | Vaccari et al. . | |
| 4,713,531 | | 12/1987 | Fennekels et al. . | |
| 4,908,497 | * | 3/1990 | Hjortsberg | 219/539 |
| 5,300,101 | | 4/1994 | Augustine et al. . | |
| 5,300,102 | | 4/1994 | Augustine et al. . | |
| 5,350,417 | | 9/1994 | Augustine . | |
| 5,405,371 | | 4/1995 | Augustine et al. . | |
| 5,714,738 | | 2/1998 | Hauschulz et al. . | |
| 5,891,189 | | 4/1999 | Payne, Jr. . | |
| 6,078,026 | * | 6/2000 | West | 219/212 |

FOREIGN PATENT DOCUMENTS

| | | |
|---|---|---|
| 41 40 507 | 4/1993 | (DE) . |
| 2 577 390 | 8/1986 | (FR) . |
| 8-106895 | 4/1966 | (JP) . |

OTHER PUBLICATIONS

"MBBNet profile of Augustine Medical, Inc." <http://www.mbbnet.umn.edu/company_folder/ami.html>>, pp. 1–2, Augustine Medical, Inc., Copyright 1999.

(List continued on next page.)

*Primary Examiner*—Tu Ba Hoang
(74) *Attorney, Agent, or Firm*—Husch & Eppenberger, LLC; Robert E. Muir; Richard J. Musgrave

(57) ABSTRACT

A disposable blanket for one-time patient use for warming a patient includes a heating matrix associated with a sheet of plastic film and a circuit printed on one side of the sheet of plastic film, a cover, and a connecting mechanism for connecting the heating matrix with a power source. The power source for the blanket can be supplied by rechargeable batteries, a wall outlet, or a cigarette lighter. The blanket is thrown away after use.

23 Claims, 11 Drawing Sheets-

OTHER PUBLICATIONS

"Augustine Medical" Home Page, <<http://www.augustine-medical.com/>>, p. 1., Augustine Medical, Inc., Copyright 1999.

"Augustine Medical—About Us" Web Page, <<http://www.augustinemedical.com/html/about_us.html>>, pp. 1–2, Augustine Medical, Inc., Copyright 1999.

"Bair Hugger Temperature Management" Web page, <http://www.augustinemedical.com/html/tm_home.html>>, p. 1., Augustine Medical, Inc., Copyright 1999.

"Bair Hugger Temperature Management—Benefits of Warning " Web page, <<http://www.augustinemedical.com/html/benefits_of_warning.html>>, pp. 1–2., Augustine Medical, Inc., Copyright 1999.

Frank, S.M. et al.; *Perioperative Maintenance of Normothermia Reduces the Incidence of Morbid Cardiac Events. JAMA*, 14:277, pp. 1127–1134, Apr., 1997.

Cheney, F.W.; *Should Normothermia be Maintained During Major Surgery? JAMA*, 14:277, pp. 1165–1166, Apr., 1997.

Kurz, A.; *Perioperative Normothermia to Reduce the Incidence of Surgical–Wound Infection and Shorten Hospitalization. New England Journal of Medicine*, 19:334, pp. 1209–1215, May, 1996.

Sessler, D.; *Mild Perioperative Hypothermia. New England Journal of Medicine*, 24:336, pp. 1730–1737, Jun., 1997.

* cited by examiner

THERMAL WARMING BLANKET FOR PATIENT TEMPERATURE MANAGEMENT

CROSS-REFERENCE

This application is a continuation-in-part of application Ser. No. 09/273,907, filed Mar. 22, 1999, now U.S. Pat. No. 6,078,026 which claims benefit of Prov. No. 60/079,455 filed Mar. 26, 1998.

FIELD OF THE INVENTION

This invention relates generally to medical devices and, more particularly, to a thermal warming blanket to be used for patient temperature management.

BACKGROUND OF THE INVENTION

Peri-operative or peri-trauma hypothermia can have serious side effects for any patient. Negative effects include a decrease in cardiovascular stability, an increase in oxygen consumption, and a decrease in resistance to infection. The benefits of maintaining normothermia are well documented. Four recent publications are as follows:

Frank, S. M. et al.; Perioperative Maintenance of Normothermia Reduces the Incidence of Morbid Cardiac Events. *JAMA,* 14:277, 1127–1134, April, 1997.

Cheney, F. W.; Should Normothermia be Maintained During Major Surgery? *JAMA,* 14:277, 1165–1166, April, 1997.

Kurz, A.; Perioperative Normothermia to Reduce the Incidence of Surgical-Wound Infection and Shorten Hospitalization. *New England Journal of Medicine,* 19:334, 1209–1213, May, 1996.

Sessler, D.; Mild Perioperative Hypothermia. *New England Journal of Medicine,* 24:336, June, 1997.

Many methods have been employed to warm peri-operative and peri-trauma patients including heat lamps, water mattresses, warmed hospital blankets and warm air blowers. These have frequently proven to be impractical under usual operating constraints.

The most common method of treating hypothermia, heated hospital blankets, requires six or more applications before reaching normothermia. The small amount of heat retained by a cotton blanket quickly dissipates, thereby requiring the patients to rewarm themselves. Although warm blankets are simple and safe, they are inconvenient and time-consuming for the nursing staff.

A warm air heated blanket system is sold by Augustine Medical, Inc. under the name Bair Hugger™ Patient Warming System. This system is effective but requires a heavy heater/blower system that in many instances is impractical in confined hospital spaces. Also, this system is not desirable for patients with open wounds because the blower system can circulate germs.

A less common rewarming technique is the use of a water circulating mattress. The equipment is heavy, complex, expensive, and may leak. None of these warming systems are usable by paramedic rescue units or in an emergency room, where they are often needed most.

It is desirable to provide a system for warming patients which system overcomes one or more of the above described disadvantages.

It is an object of this invention to provide a disposable, electric cover for use in hospitals and emergency situations.

Another object of this invention to provide a portable power source to be connected to the electric blanket.

These, and other objects and advantages of the present invention, will become apparent as the same becomes better understood from the Detailed Description when taken in conjunction with the accompanying drawings.

SUMMARY OF THE INVENTION

In accordance with the present invention there is provided a disposable blanket for one-time patient use including a sheet of plastic film having upper and lower sides, a heating matrix associated with the sheet of plastic film, the heating matrix including a circuit printed on one side of the sheet of plastic film, a cover extending over the printed circuit side of the sheet of plastic film, means for connecting the heating matrix with a power source, and means for controlling the temperature of the heating matrix.

In accordance with another aspect of the present invention there is provided a disposable blanket for one-time patient use including a sheet of polyethylene film having upper and lower sides; a heating matrix associated with one side of the sheet of plastic film; a polypropylene cover extending over the heating matrix at said one side of the sheet of polyethylene film; and means for connecting the heating matrix to a power source.

The present invention treats peri-operative and peri-trauma hypothermia by creating a personal environment of comforting warmth. The embodiment precludes patient hypothermia by providing patient warmth by means of a substantially fixed temperature disposable blanket for one-time patient use which operates at approximately 100 degrees Fahrenheit. The blanket is advantageously heated by a rechargeable 12 volt direct current battery package. A thermostat is advantageously located in the middle of the blanket and is connected to a temperature controller which controls the flow of current so that the temperature of the blanket remains at about 100 degrees Fahrenheit.

BRIEF DESCRIPTION OF THE DRAWINGS

Reference is made to the drawings which illustrate the best known mode of carrying out the invention.

DETAILED DESCRIPTION

Figure 1:
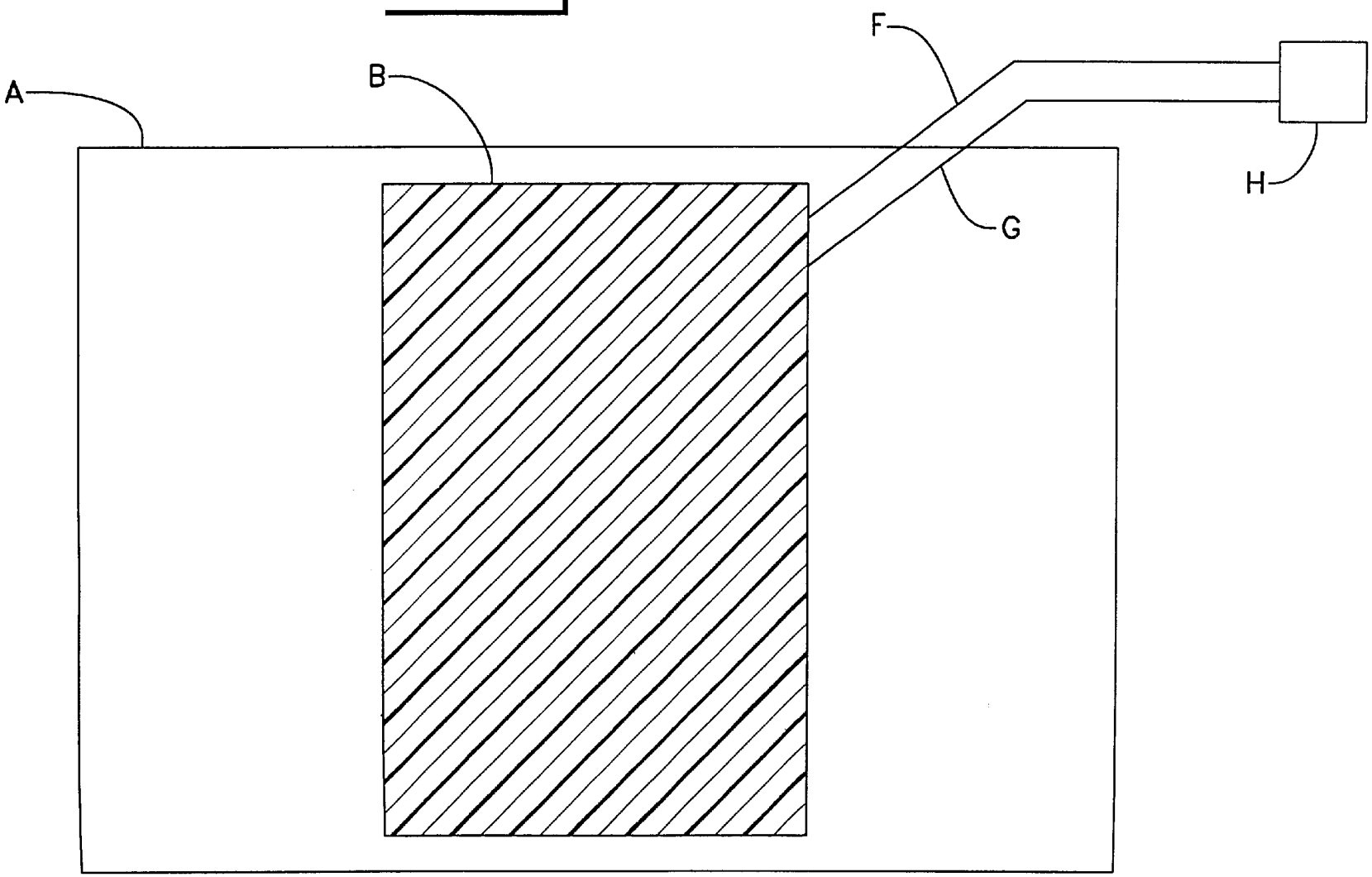
FIG. 1 is a plan view showing the construction of the blanket prior to complete assembly.

Reference is now made more particularly to the drawings which illustrate the best presently known mode of carrying out the invention and wherein similar reference characters indicate the same parts throughout the several views. FIG. 1 shows a disposable blanket A which advantageously is 54 inches wide and 40 inches long and contains an imbedded heating pad structure B which advantageously is 21 inches wide and 36 inches long. The blanket A is constructed of any material which meets the flammability requirements of the National Fire Protection Association Standard NFPA 702-1980. In one embodiment, the cover is made of a non-woven polypropylene base fabric such as is employed in disposable surgical drapes and gowns.

Figure 2:
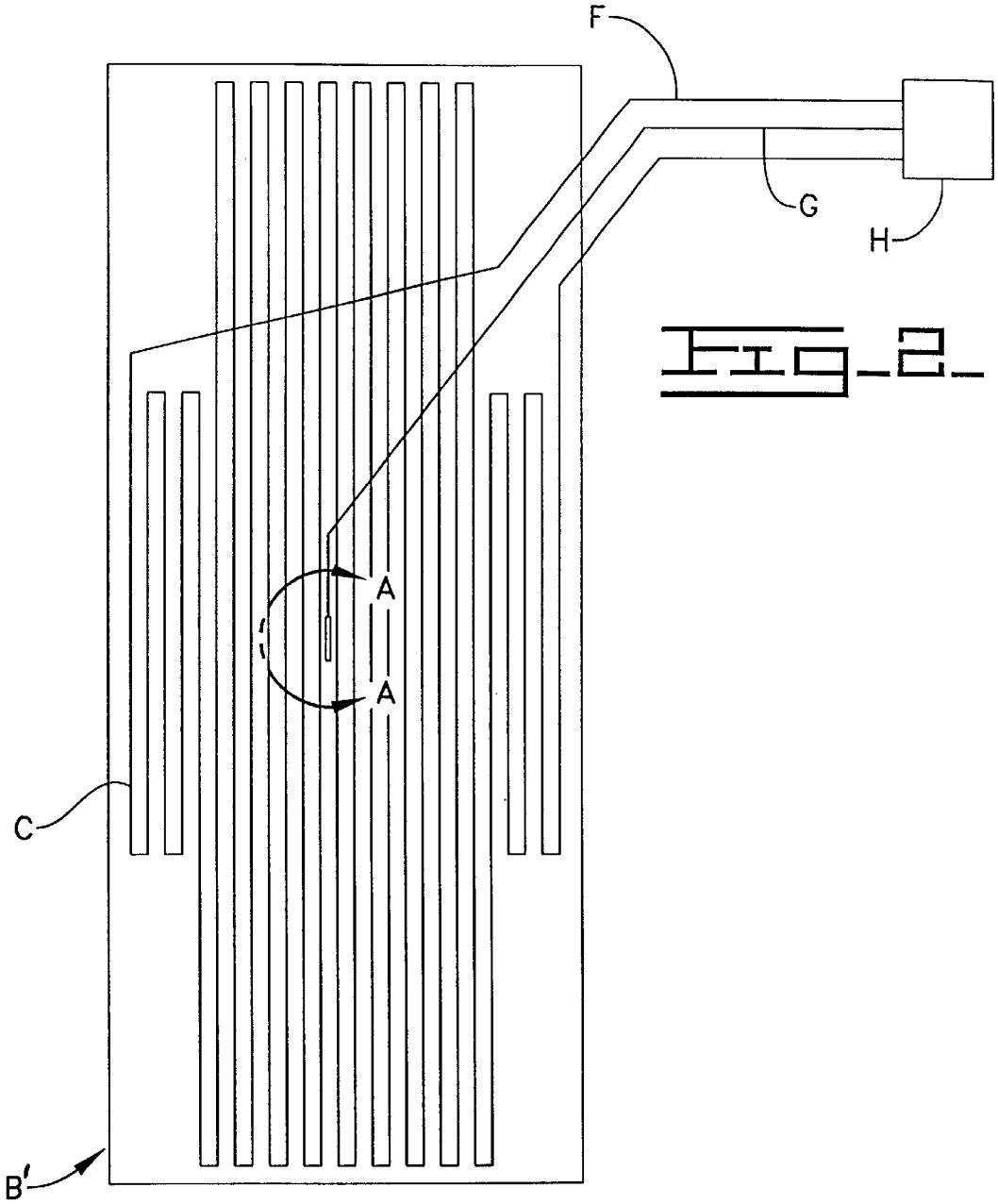
FIG. 2 is an illustration of the heating element matrix.
Figure 7:
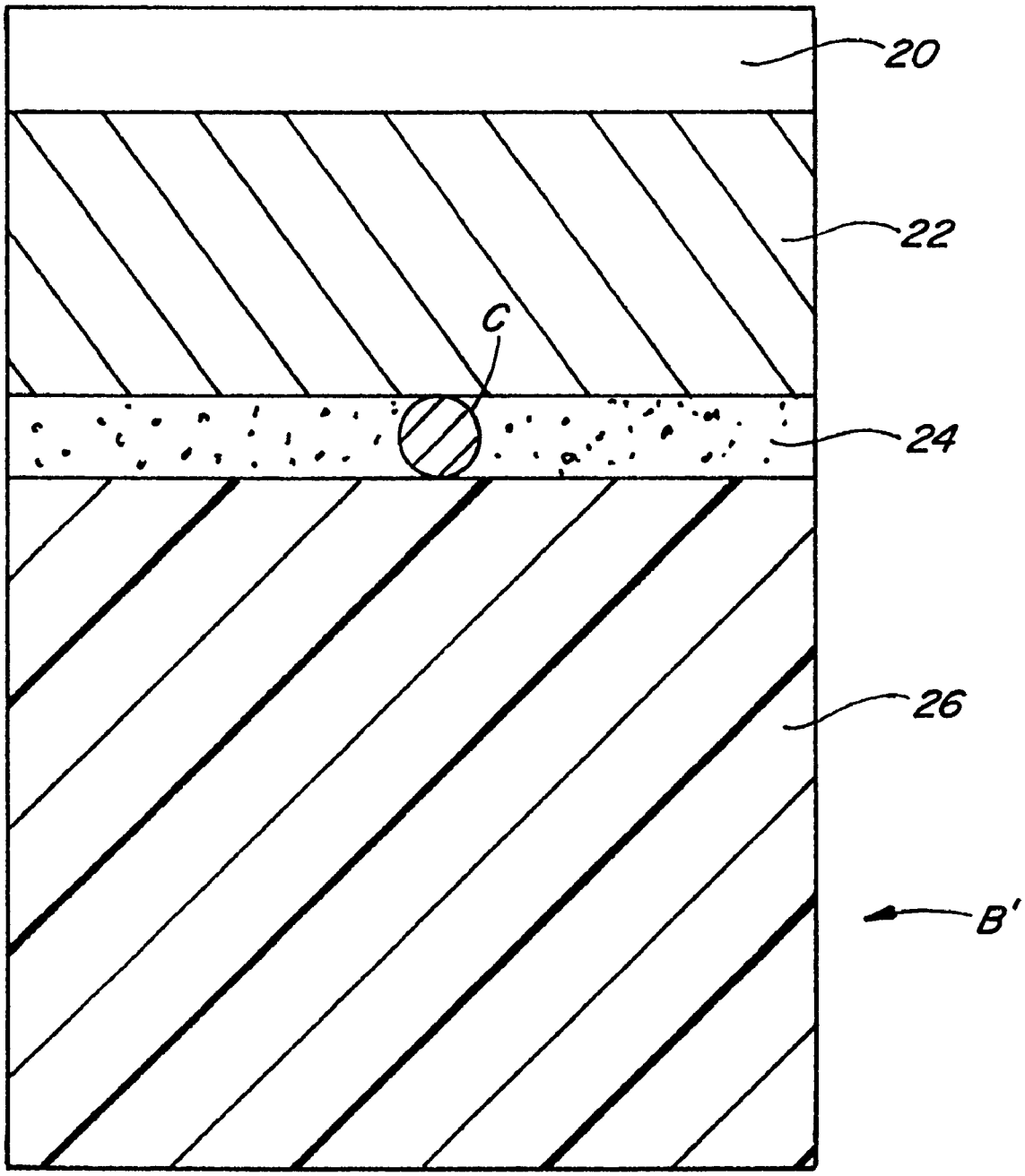
FIG. 7 is a sectional view of the blanket showing the wire held by an adhesive.
Figure 8:
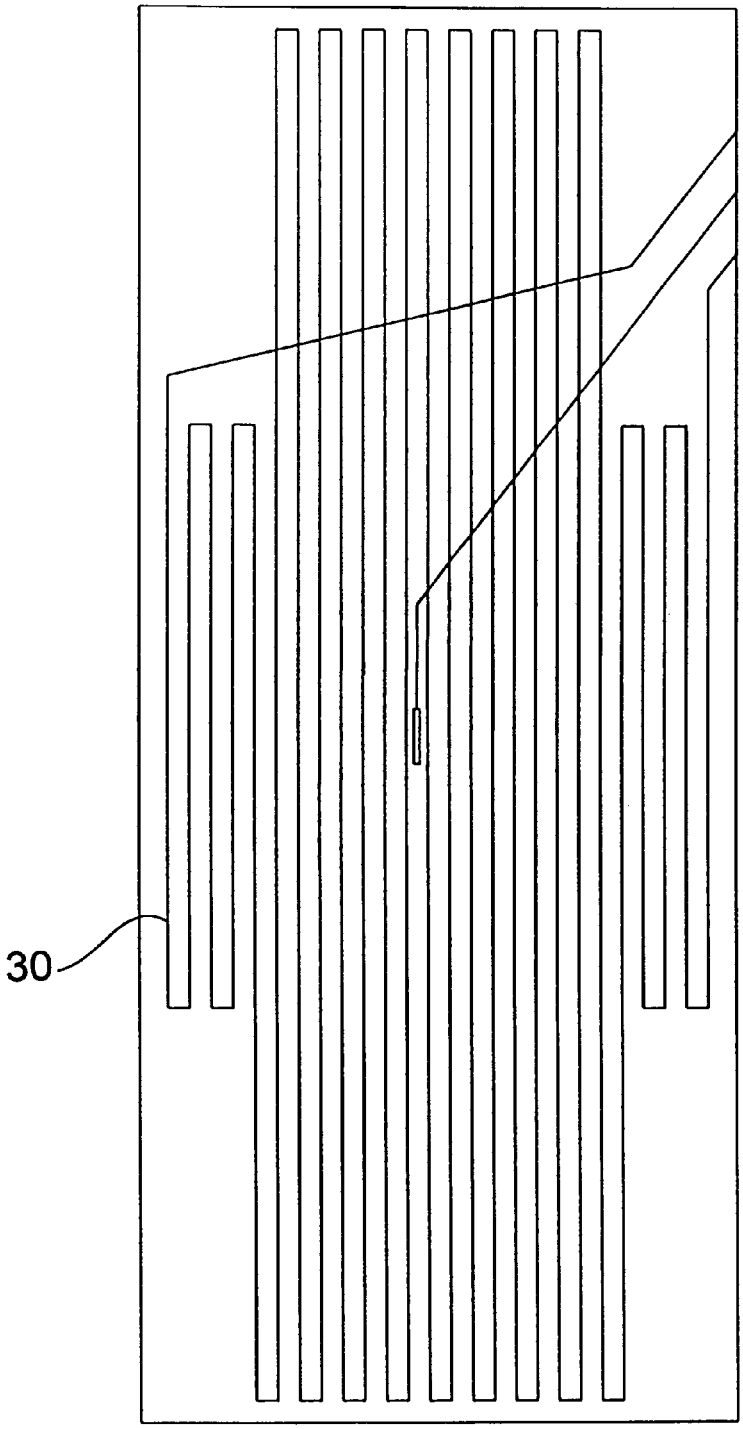
FIG. 8 is an illustration of an alternate design of the heating matrix.

The heating pad structure B includes a heating element matrix shown in FIGS. 2 and 8. In the embodiment of FIG. 2, the heating element matrix is constructed of wires C that are encapsulated between two thin sheets of non-flammable reflective plastic film B'. The film B' is CURLAM® Grade 8019-I protective packaging film which is a flexible, non-formed web which meets the requirements for a food contact material under the Food Additive Regulations. CURLAM® is a registered trademark of Curwood, Inc. of Oshkosh, Wis. In one embodiment shown in FIG. 7, the matrix is placed between the plastic sheets and stitched into the blanket. In an alternative embodiment a glue is used to secure the film B' and encapsulate the wires C. The encapsulating glue is Scotch-Grip 4475 Plastic Adhesive. When this glue is thoroughly dry it is not flammable and will burn only when subjected to a flame or temperature sufficient to cause thermal decomposition of the adhesive, which occurs at about 350 degrees Fahrenheit. The wire C is 24 gauge plastic coated seven strand hookup wire. The heating element matrix advantageously contains 72 feet of wire placed as 30 inch and 36 inch loops as illustrated in FIG. 2 within the layers of the plastic film B'. The encapsulated heating element matrix is waterproof and the blanket will function even when submerged in water.

Figure 5:
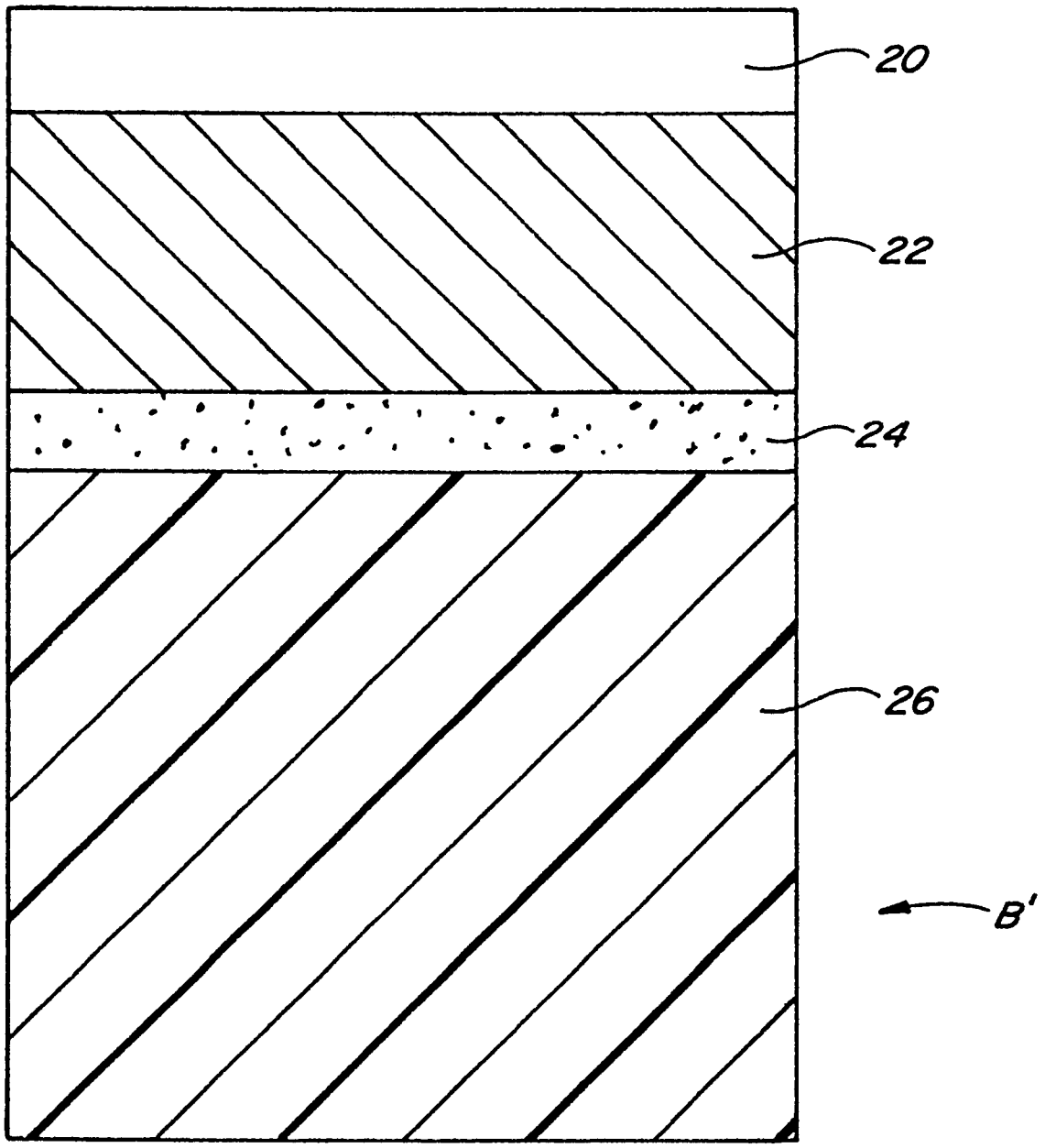
FIG. 5 is a sectional view taken along B—B in FIG. 6
Figure 6:
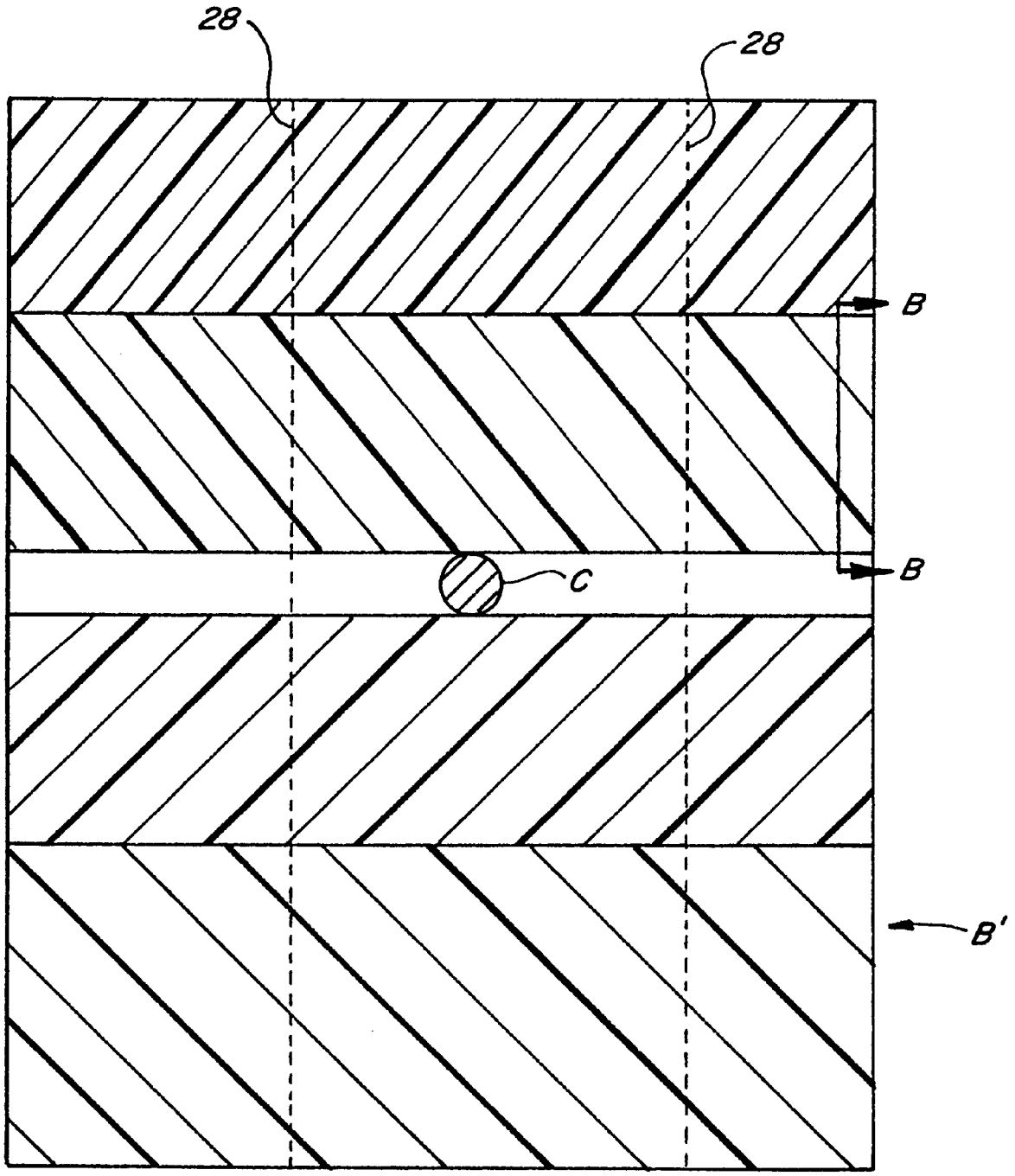
FIG. 6 is a sectional view of the blanket showing the stitching for holding a wire.

FIG. 5 is a sectional view along B—B of FIG. 6 of the CURLAM® Grade 8019-I protective packaging film which includes a layer 26 of 2.5 mil linear low density polyethylene (LLDPE), and a layer 22 of 48 ga. metallized polyethylene terephthalate (PET) held by an intermediate layer 24 of adhesive. Conveniently, the layer 22 can have a surface print 20. This feature allows the introduction of another embodiment of the heating matrix illustrated in FIG. 8. The heating matrix is formed by a circuit 30 printed on the layer of metallized polyethylene terephthalate. This design results in a very flexible and extremely low-profile, low weight blanket. The printed circuit 30 follows the basic layout of the wire matrix described above.

Figure 2A:
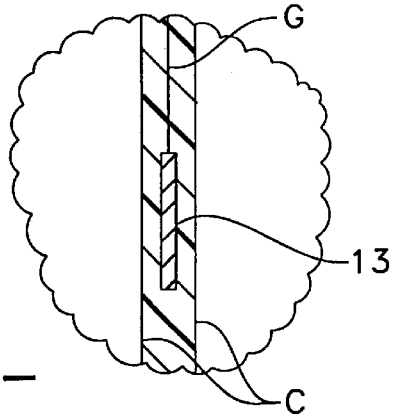
FIG. 2A is an enlarged, cross-sectional illustration of a thermocouple taken along lines A—A in FIG. 2.

Temperature of the blanket is regulated at approximately 100 degrees Fahrenheit by a temperature controller TC (see FIG. 9) and, advantageously, a temperature sensing means 13 (see FIG. 2A). The temperature sensing means may be any standard temperature sensing device such as a thermocouple, thermistor, resistance temperature detector, bimetallic thermometer, or semiconductor temperature sensor. In a preferred embodiment the temperature controller TC has an accuracy of +/−1 degree Fahrenheit. A commercially available temperature controller which will serve this purpose is the Fenwal Temperature Controller sold by Fenwal, Inc. of Ashland, Mass. This results in an effective blanket temperature in the range of +/−5 degrees Fahrenheit. The temperature controller includes a circuit board (not shown) which is located inside a portable case 11 and which acts as a SPST relay, with normally open contacts. The circuit board is operatively connected to at least one sealed, maintenance free, rechargeable 12 volt battery (not shown) inside the portable case 11 to regulate the flow of current to the heating matrix shown in FIGS. 2 and 8. The temperature sensing means 13 is advantageously in the form of a probe in communication with the heating matrix as described above.

In one embodiment, a power cord F is an integral part of the blanket A and is disposable with the blanket. Another cord G is connected to the temperature sensing means 13. The cords F, G terminate in a male plug H. In the illustrated embodiment the cords F, G are 18 gauge and 10 feet in length. The cords F, G have been described as separate; however they may be packaged inside a single sheath or covering. The plug H is for connection to a labeled female receptacle 16 on the front of a supply power pack 10 best seen in FIG. 3. The cords F, G are secured to the blanket by adhesive, stitching, or solder.

Figure 9:
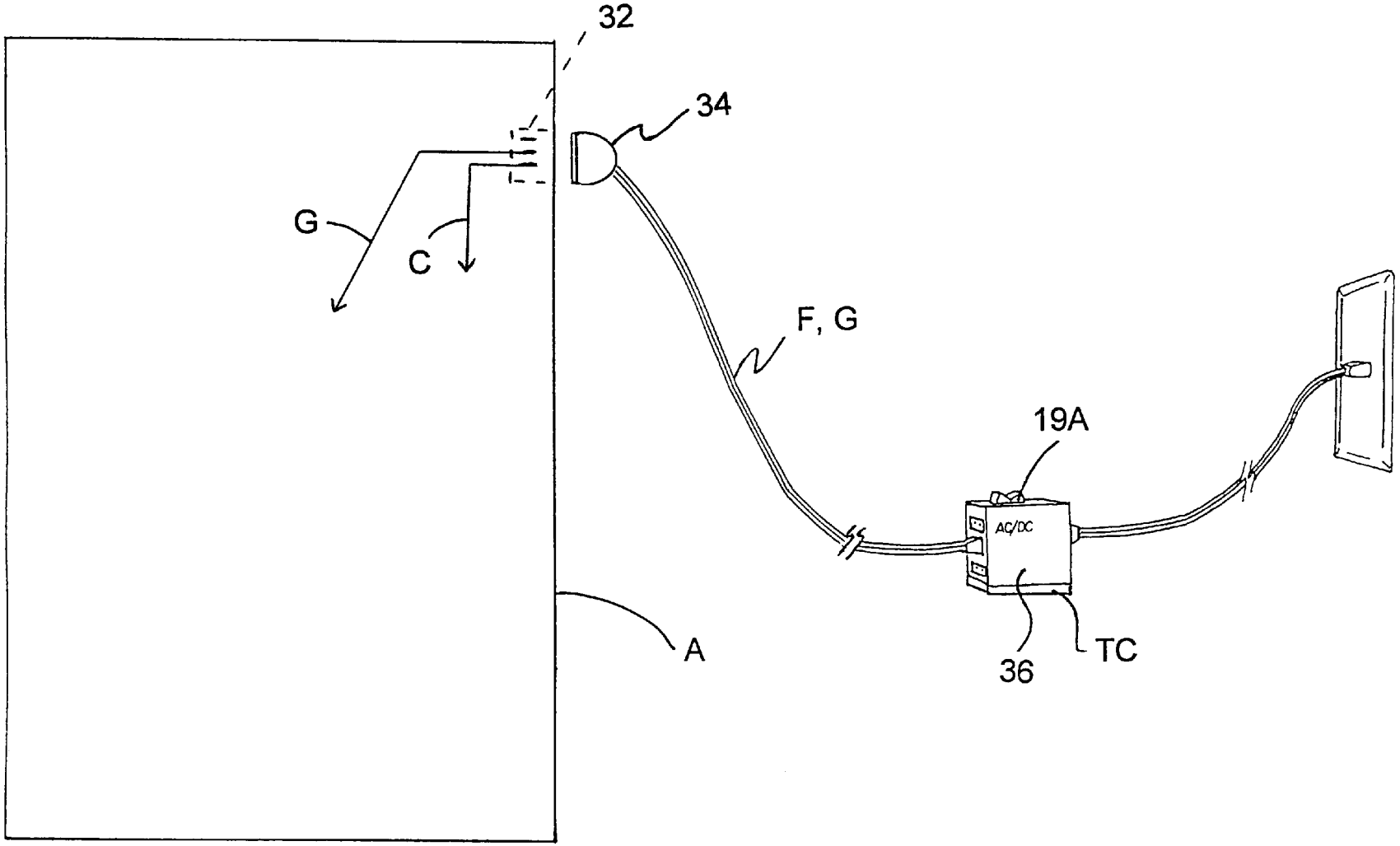
FIG. 9 is an illustration of a blanket with detachable power and temperature sensor cords.

In another embodiment shown in FIG. 9, the cords F, G are separable from the blanket. A plug 32 is attached to the blanket and has separate electrical connections 33, 35 with the heating matrix and temperature sensing means, respectively. The plug 32 is secured to the blanket by adhesive, stitching, or solder. The cords F, G are provided with a mating plug 34 to connect to the plug 32 attached to the blanket.

Figure 3:
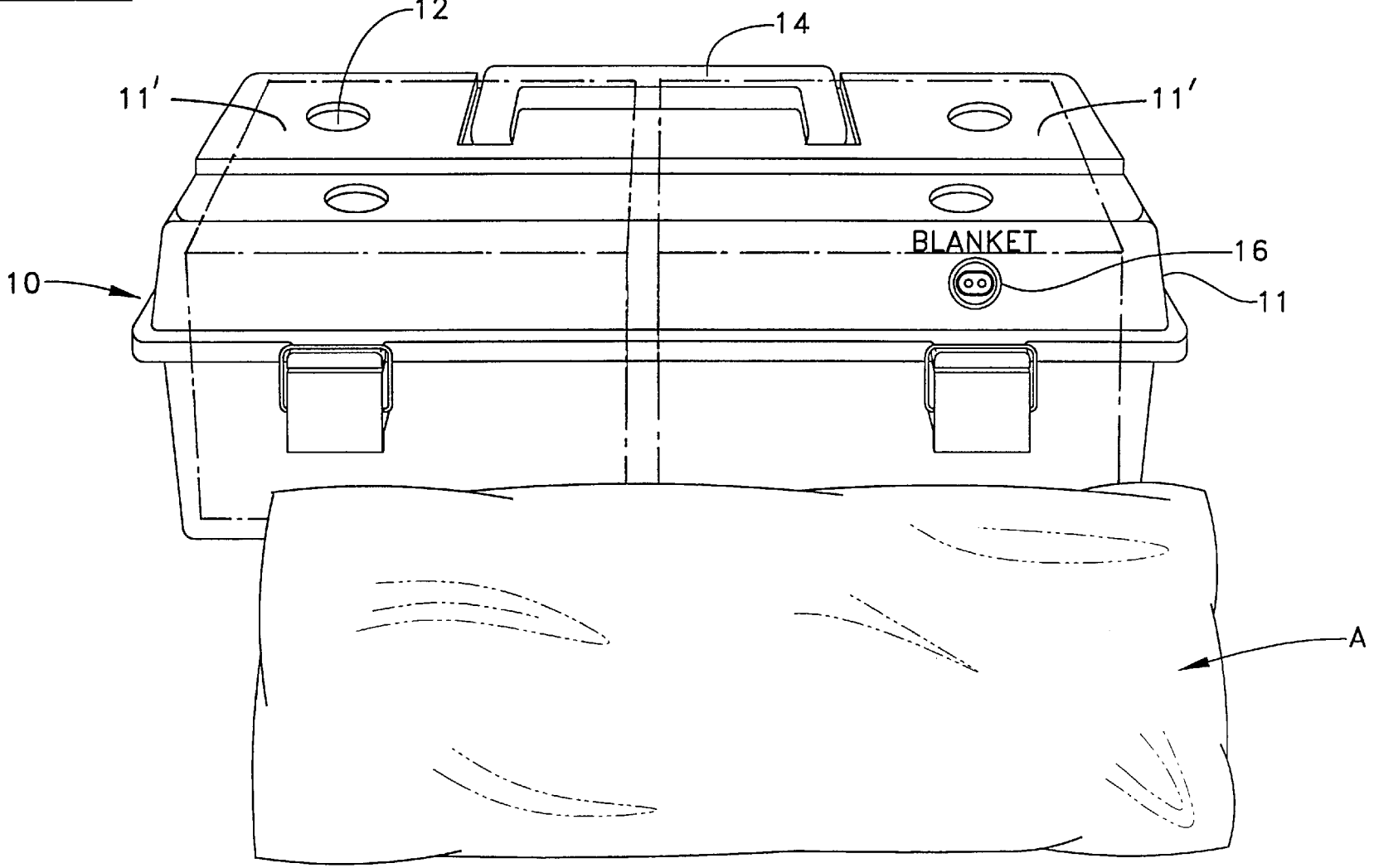
FIG. 3 is an illustration of a power case and the blanket.

The supply power pack 10 shown in FIG. 3 includes at least one sealed, maintenance free, rechargeable 12 volt battery shown in phantom lines at 11' inside the portable case 11. Together the case 11 and batteries weigh about 30 pounds. The case 11 is arranged so that it cannot be opened in the field. A socket 16, labeled BLANKET in FIG. 3, is located at the front of the case 11 and accepts the plug H. Each of the batteries has a 19 amp- hours rating for a total of 38 amp- hours. The blanket A has a maximum power draw of 6.5 amps. With fully charged batteries, the blanket will reach its target temperature (i.e. 100 degrees Fahrenheit or 38 degrees Celsius) in approximately 5 minutes and will remain heated for five to eight hours.

Figure 4:
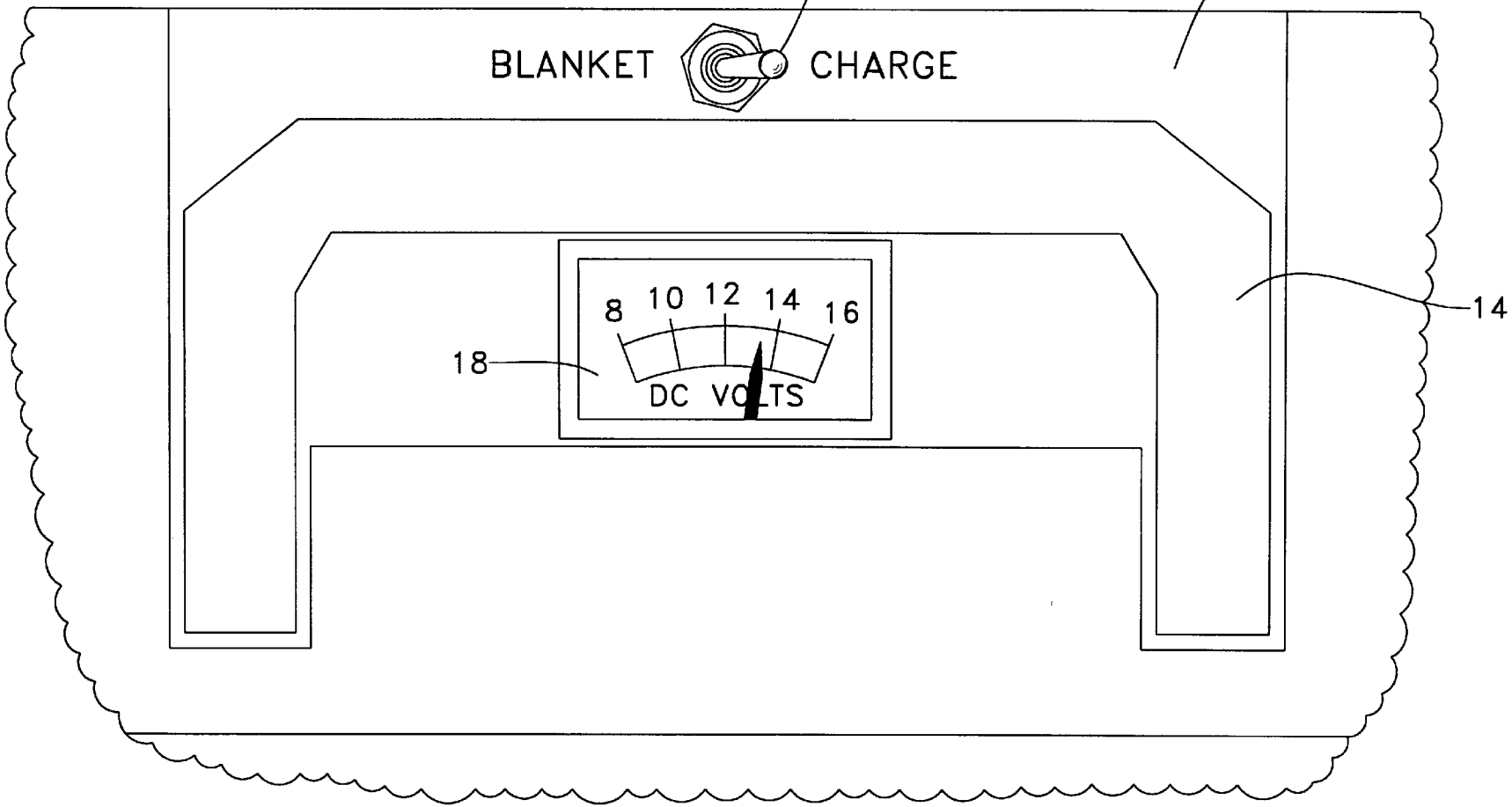
FIG. 4 is an illustration of a portion of the top of the power case on a larger scale than FIG. 3.

As shown in FIG. 4, a battery condition gauge 18 is located on the case 11 and indicates when the batteries require recharging. A socket (not shown) at the rear of the case 11 accepts a charger connector. A toggle switch 19 is arranged so that it is not possible to operate the battery charger when the blanket A is in use; and, likewise when charging, the power connection to the blanket is terminated. For this purpose, the toggle switch 19 has BLANKET and CHARGE positions, as shown in FIG. 4.

Figure 10:
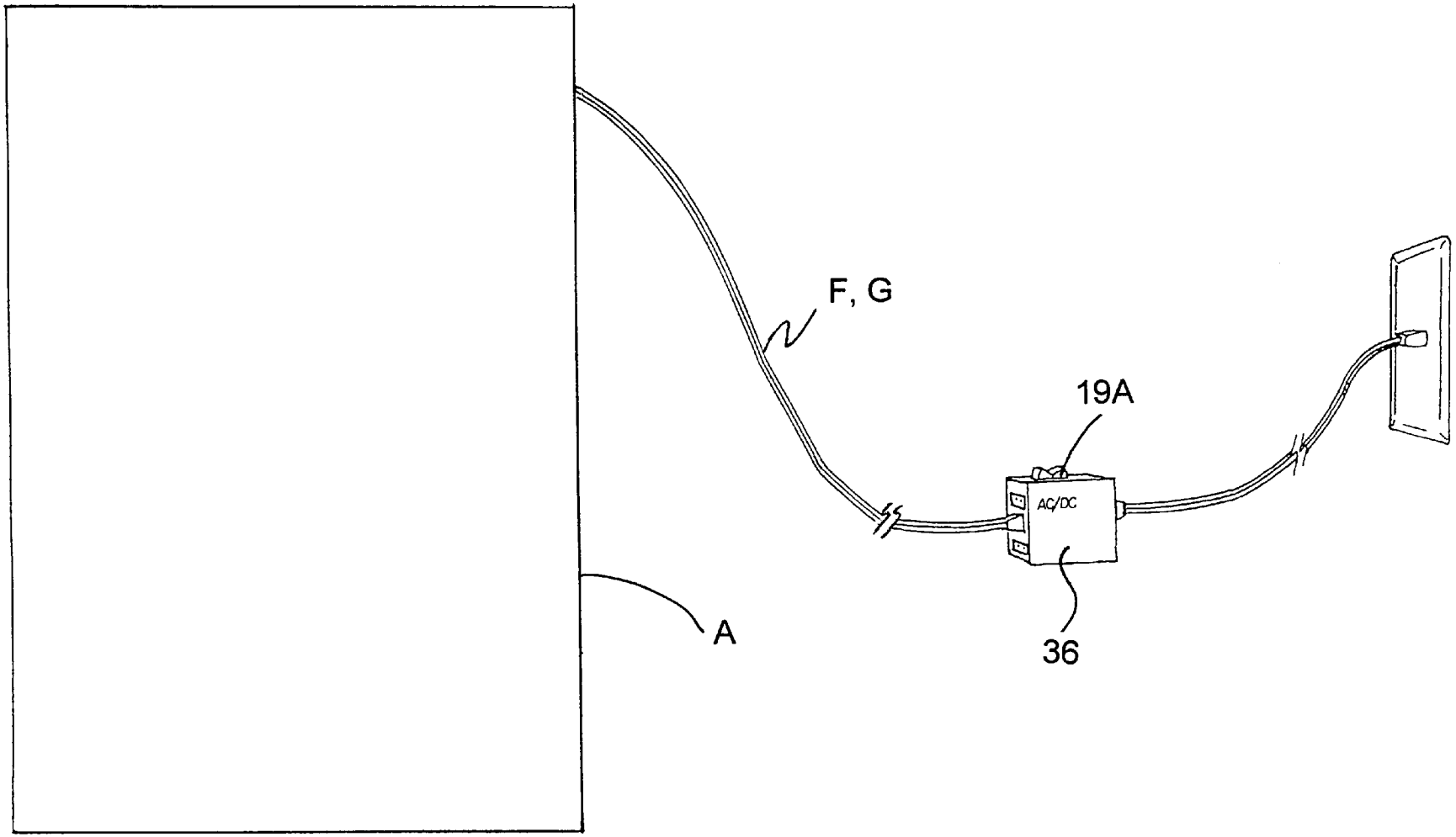
FIG. 10 is an illustration of a blanket capable of using a wall outlet as an alternate power source.
Figure 11:
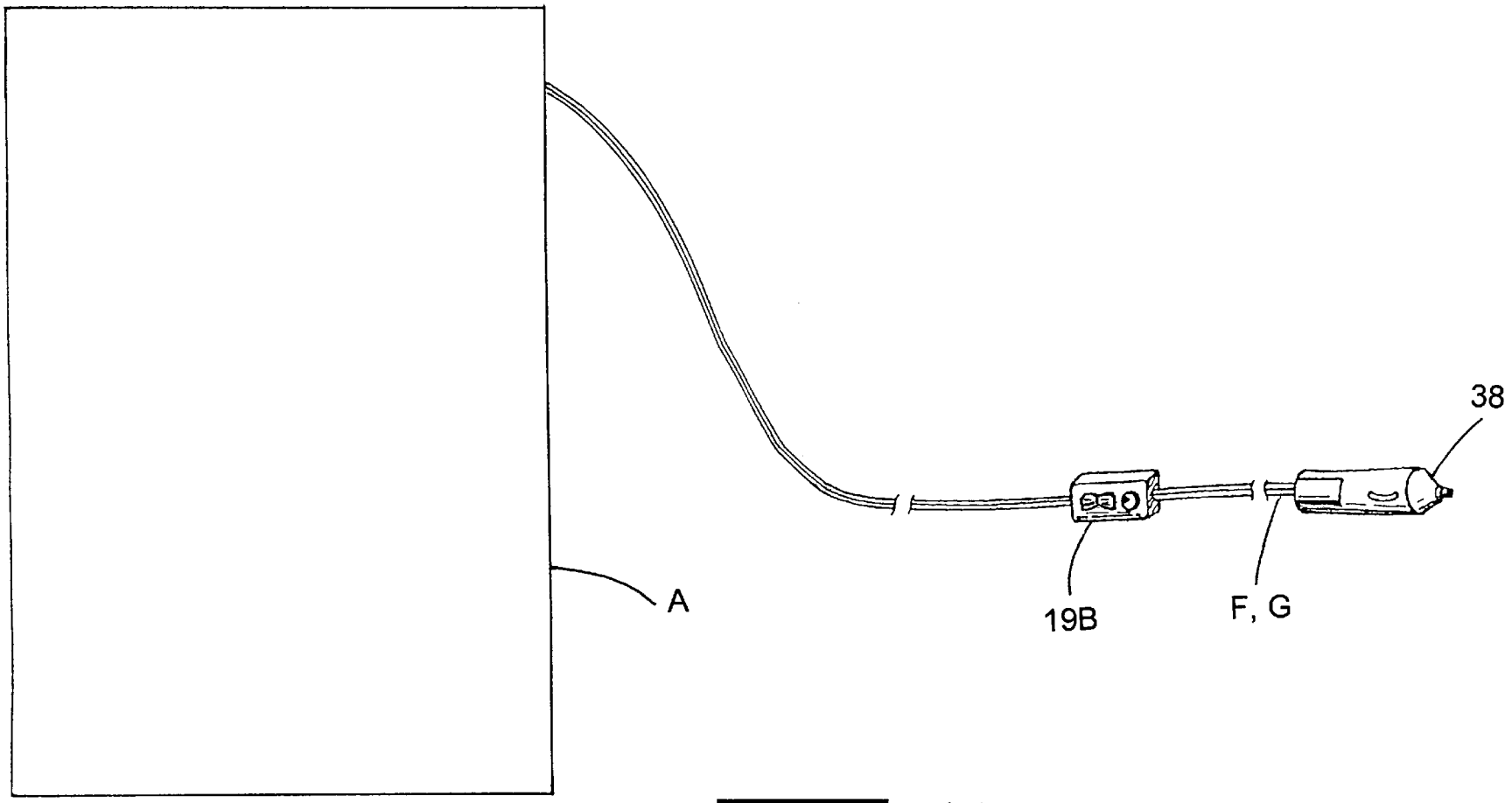
FIG. 11 is an illustration of a blanket capable of using a cigarette lighter as an alternate power source.

Power may also be supplied to the blanket via a standard 110 V AC electrical wall outlet or an automobile battery via its cigarette lighter receptacle. If a wall outlet is the desired power source, an AC/DC converter 36, shown in FIG. 10, is provided to supply the blanket with direct current. A switch 19A is conveniently provided for on-off control of power. The power cord can be supplied with a plug 38, shown in FIG. 11, to allow use of the blanket with a cigarette lighter receptacle. Again an on-off switch 19B is provided in cords F, G.

In use, the blanket A is for patient heat at approximately 100 degrees Fahrenheit (38 degrees Celsius). It is designed to be disposable and is intended for single patient use only because it is non-sterile. For best results, one places the blanket A in direct contact with the patient and place the patient's regular blanket or sheet over the blanket A. After the blanket A is in place, one places the plug H into the socket 16 which is labeled BLANKET on the case 11. One sets the switch 19 to the BLANKET position as shown in FIG. 4. The blanket A will not heat if the switch 19 is in the CHARGE position. Preferably one recharges the batteries in the supply power pack 10 after each use. For recharging one places the switch in the CHARGE position shown in FIG. 4. Medical personnel should monitor the patient's temperature and vital signs regularly.

While preferred embodiments of the invention have herein been illustrated and described, this has been done by way of illustration and not limitation, and the invention should not be limited except as required by the scope of the appended claims.

I claim:

1. A disposable blanket for one-time patient use including:

a sheet of plastic film having upper and lower sides;

a heating matrix associated with the sheet of plastic film, the heating matrix including a circuit printed on one side of the sheet of plastic film;

a cover extending over the printed circuit side of the sheet of plastic film; and means for connecting the heating matrix to a power source.

2. A disposable blanket for one-time patient use as set forth in claim 1, wherein the sheet of plastic film is made of a flexible, non-formed web having a layer of linear low density polyethylene and a layer of metallized polyethylene terephthalate.

3. A disposable blanket for one-time patient use as set forth in claim 1, wherein the cover is made of a sheet of a non-flammable material.

4. A disposable blanket for one-time patient use as set forth in claim 3, wherein the non-flammable material is a non-woven polypropylene fabric.

5. A disposable blanket for one-time patient use as set forth in claim 2, wherein the circuit is printed on the layer of metallized polyethylene terephthalate of the sheet of plastic film.

6. A disposable blanket for one-time patient use as set forth in claim 1, wherein there are two sheets of plastic film and the heating matrix includes wires encapsulated between the two sheets of plastic film.

7. A disposable blanket for one-time patient use as set forth in claim 1, wherein the power source is a direct current power source.

8. A disposable blanket for one-time patient use as set forth in claim 7, wherein the direct current power source is comprised of a rechargeable battery.

9. A disposable blanket for one-time patient use as set forth in claim 8, including a circuit controlled by a two-position switch which prevents power from being supplied to the heating matrix while the rechargeable batteries are being recharged.

10. A disposable blanket for one-time patient use as set forth in claim 7, including an AC/DC converter to allow a standard 110V AC wall outlet to act as the power source.

11. A disposable blanket for one-time patient use as set forth in claim 1, wherein the means for connecting the power source with the heating matrix includes a power cord with a first end attached to the sheet of plastic film, said first end being electrically connected with the heating matrix, and a second end detachably connected with the power source.

12. A disposable blanket for one-time patient use as set forth in claim 11, wherein the first end of the power cord is attached to the sheet of plastic film by an adhesive.

13. A disposable blanket for one-time patient use as set forth in claim 11, wherein the first end of the power cord is attached to the sheet of plastic film by stitching.

14. A disposable blanket for one-time patient use as set forth in claim 1, wherein the means for connecting the power source with the heating matrix includes a plug attached to the sheet of plastic film, said plug being electrically connected with the heating matrix, and a power cord with first and second ends and with a receptacle at the first end designed to accept the plug and detachably connected at the second end with the power source.

15. A disposable blanket for one-time patient use as set forth in claim 14, wherein the plug is attached to the sheet of plastic film by an adhesive.

16. A disposable blanket for one-time patient use as set forth in claim 14, wherein the plug is attached to the sheet of plastic film by stitching.

17. A disposable blanket for one-time patient use as set forth in claim 14, wherein the plug is soldered to the sheet of plastic film.

18. A disposable blanket for one-time patient use as set forth in claim 14, wherein the second end of the power cord is provided with a second plug suitable for insertion into a cigarette lighter receptacle, allowing the cigarette lighter to function as the power source.

19. A disposable blanket for one-time patient use as set forth in claim 1, wherein the means for controlling the temperature of the heating matrix includes a temperature sensing means in communication with the heating matrix and a temperature controller connected with the temperature sensing means.

20. A disposable blanket for one-time patient use including a sheet of polyethylene film having upper and lower sides; a heating matrix associated with the polyethylene film, the heating matrix having a heating circuit printed on one side of the sheet of the polyethylene film; a polypropylene cover extending over the heating matrix at said one side of the sheet of polyethylene film; and means for connecting the heating matrix to a power source.

21. A heating article including:

a sheet of plastic film having upper and lower sides;

a heating circuit printed on one side of the sheet of plastic film;

a plastic cover extending over said one side of the sheet of plastic film;

means for encapsulating the heating circuit; and means for connecting the heating circuit to a power source.

22. A heating article as set forth in claim 21, including means for controlling temperature of the heating circuit.

23. A heating article as set forth in claim 22, wherein the means for controlling temperature of the heating circuit includes temperature sensing means in communication with the heating matrix and a temperature controller connected with a temperature sensor.

* * * * *